United States Patent [19]

Bouvier

[11] 4,099,323

[45] Jul. 11, 1978

[54] METHOD OF MAKING ELECTRICAL CONNECTOR

[75] Inventor: Alfred Joseph Bouvier, Sidney, N.Y.

[73] Assignee: The Bendix Corporation, Southfield, Mich.

[21] Appl. No.: 751,931

[22] Filed: Dec. 17, 1976

Related U.S. Application Data

[62] Division of Ser. No. 657,124, Feb. 11, 1976, Pat. No. 4,019,799.

[51] Int. Cl.[2] ..... H01R 43/04

[52] U.S. Cl. ..... 29/629; 29/520; 29/523; 156/294; 264/262

[58] Field of Search ..... 29/629, 520, 523, 507, 29/508; 339/59 M–61, 59 R, 136 R, 136 C, 136 M, 137, 139, 140, 142; 156/294; 264/262

[56] References Cited

U.S. PATENT DOCUMENTS

| | | | |
|---|---|---|---|
| 2,312,579 | 3/1943 | O'Brien | 264/262 |
| 2,686,337 | 8/1954 | Kaufman | 156/294 |
| 3,165,369 | 1/1965 | Maston | 339/59 M |
| 3,184,362 | 5/1965 | Litsky et al. | 156/294 |
| 3,192,308 | 6/1965 | Van Horssen et al. | 339/60 C |
| 3,503,034 | 3/1970 | Appleton | 339/61 R |
| 3,529,856 | 9/1970 | Smith et al. | 29/520 |
| 3,631,375 | 12/1971 | Bridle | 339/59 M |
| 3,641,865 | 2/1972 | Swindt et al. | 29/520 |
| 3,727,172 | 4/1973 | Clark | 339/59 M |
| 3,810,071 | 5/1974 | Eifler | 339/59 M |
| 3,938,874 | 2/1976 | Bourdon | 339/59 M |

FOREIGN PATENT DOCUMENTS

| | | | |
|---|---|---|---|
| 748,208 | 4/1956 | United Kingdom | 29/520 |

*Primary Examiner*—C.W. Lanham
*Assistant Examiner*—Daniel C. Crane
*Attorney, Agent, or Firm*—Kenneth A. Seaman; Raymond J. Eifler; S. H. Hartz

[57] ABSTRACT

A method of making an electrical connector, which has a shell, an insert member and a wafer member, said insert member and wafer member stacked in the shell having apertures therein for receiving electrical terminals, the method including assembling the insert member with the wafer member with the apertures in the member and wafer aligned, wrapping a deformable laminate around the members, inserting the assembled members and laminate into the shell with the insert member, engaging a forward-face of the shell, then inserting a first sleeve into the shell in engagement with the laminate and applying a force to the sleeve to deform the laminate in the space between the shell and the insert member and wafer member. The deformed laminate preferably substantially fills the forward portion of the shell and is coated with a thermo-setting material which may be cured to more completely fill the forward portion of the shell. A grommet and a seal may be assembled with the insert member.

7 Claims, 6 Drawing Figures

METHOD OF MAKING ELECTRICAL CONNECTOR

This is a division, of application Ser. No. 657,124, filed Feb. 11, 1976, now U.S. Pat. No. 4,019,799.

The invention relates to separable electrical connectors having a dielectric insert for retaining the electrical terminals.

PRIOR ART

Electrical connectors as presently used include an outer shell with an insert assembly having apertures for receiving the electrical terminals of the connector. The insert assembly usually includes retention elements for retaining the terminals in the insert assembly during normal use. The insert assembly is encapsulated in the shell with epoxy prior to inserting the terminals. In some instances the epoxy flows into the apertures and retention elements in which the terminals are later inserted making it difficult or impossible to assemble the terminals to the insert assembly.

SUMMARY OF THE INVENTION

The present invention uses an insert member for receiving the terminals and a retention wafer for retaining the terminals in the insert member during normal use. Both the insert member and wafer are made of dielectric material. The insert member and wafer are retained in the shell by assembling a thin laminate in the space between the shell and the insert member and wafer and mechanically deforming the laminate until it substantially fills the space between the shell and insert member and engages shoulders on the insert member and wafer to prevent movement of the wafer and insert member relative to one another and relative to the shell. A silicone rubber grommet is attached to the wafer and a silicon rubber seal is attached to the insert member prior to assembly in the shell. The electrical terminals are inserted in aligned apertures in the insert member, wafer, grommet and seal and the terminals are retained therein by resilient fingers on the wafer engaging shoulders on the terminals.

The laminate preferably is made of a matrix of screen-like material impregnated with an epoxy or other thermo-setting material and the length, width and thickness of the laminate and the viscosity of the epoxy is selected so that after deformation and curing the laminate substantially fills only the space between the shell and insert assembly without overflowing into the apertures and retention elements on the wafer.

With this arrangement the passages and retention elements for receiving the terminals are not blocked by the thermo-setting material because the quantity of thermo-setting material is selected to occupy only the space between the shell and insert assembly and the viscosity is such that during curing the flow of thermo-setting material is controlled by the matrix. The present invention avoids the problem of assembling the electrical terminals to the insert member and wafer heretofore encountered.

The invention contemplates an electrical connector comprising a shell, an insert member and a wafer stacked in the shell and having apertures aligned with one another for receiving electrical terminals and retention means for retaining the electrical terminals in the apertures, and a laminate of deformable material between the shell and insert member and between the shell and wafer deformed to substantially fill the space therebetween for maintaining the insert member and wafer assembled with one another and with the shell.

The invention also contemplates a method of assembling a connector having a shell and an insert member and wafer with apertures therein for receiving electrical terminals, comprising assembling the insert member and wafer member, wrapping a deformable laminate around the members, inserting the assembled members and laminate into the shell with the insert member abutting a shoulder on the inner face of the shell, inserting a first sleeve into the shell in engagement with the laminate and applying force to the sleeve to deform the laminate in a space between the shell and members.

DRAWINGS

FIG. 1 is a cross-sectional view of a connector constructed according to the invention, FIGS. 2, 3, 4 and 5 show the successive steps of assembling the connector and deforming the laminate in the space between the shell and insert assembly and show the tool for performing this operation, and FIG. 6 shows the laminate prior to assembly.

DETAILED DESCRIPTION OF THE INVENTION

Figure 6:
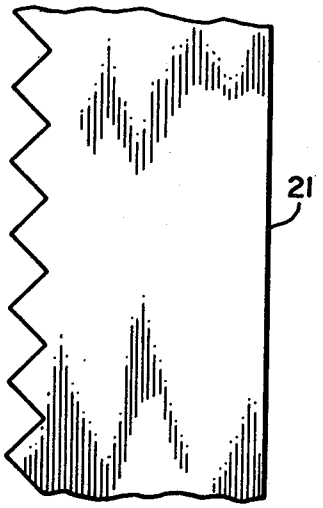
Figure 2:
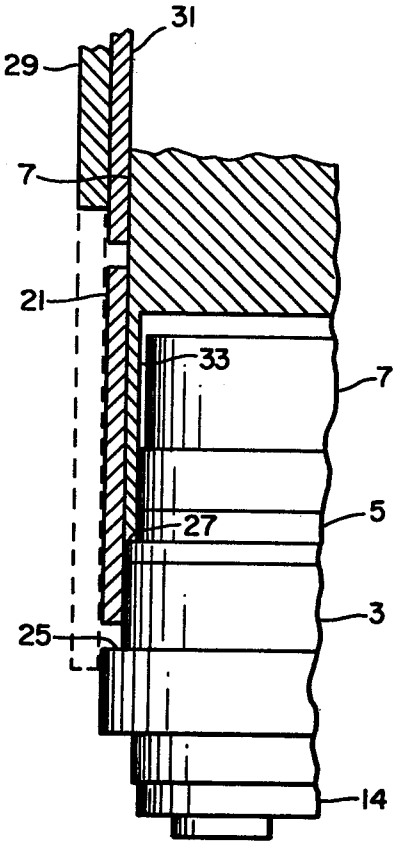
Figure 1:
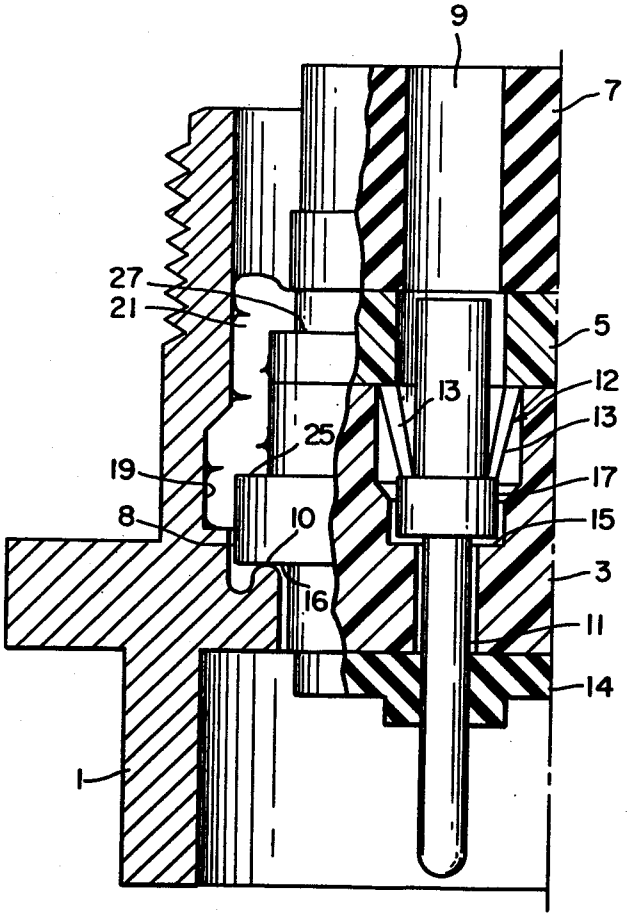

Referring to FIG. 1, the novel connector constructed according to the invention and shown therein comprises a seal 14, an insert member 3, a retention wafer 5 and a grommet 7 stacked in a cylindrical shell 1 with a shoulder 16 formed by a collar 8 on insert member 3 engaging a locating surface 10 on inner face of the shell. Insert member 3 and retention wafer 5 may be made of dielectric material and seal 14 and grommet 7 may be made of silicon rubber or other suitable material. Insert member 3 and wafer 5 are bonded together by a solvent and seal 14 and grommet 7 may be attached to insert member 3 and retention wafer 5 by adhesive. Seal 14, insert member 3, wafer 5 and grommet 7 have aligned apertures 9 therein for receiving electrical terminals 11. Wafer 5 has retention towers 12 formed integrally therewith by resilient elements 13 surrounding each electrical terminal. The resilient elements follow the contour of the terminal as the terminal is installed in aperture 9. When a collar 17 on the terminal is bottomed on a shoulder 15 in aperture 9 in insert member 3 resilient elements 13 move together and engage the collar to prevent disassembly of the terminal during normal use of the connector. The terminals can be removed from the apertures in case of malfunction or other reason by inserting a special tool (not shown) in the apertures having a sleeve surrounding the terminals for moving the resilient elements apart sufficiently to clear collar 17 on the terminals while removing the terminals.

Prior to assembling seal 14, insert member 3, wafer 5 and grommet 7 in shell 1, a ribbon laminate 21 is wrapped around the stacked insert member, wafer and grommet and the shell is then assembled to the stack with the laminate positioned between the shell and insert member, wafer and grommet. The laminate is deformed prior to inserting the terminals by a pressure tool shown in FIGS. 2 to 5 and described hereinafter until the laminate substantially fills the space, including an annular groove 19 in the inner face of shell 1, between the shell and insert member and wafer and engages a shoulder 25 formed by collar 8 on insert member 3 and a shoulder 27 on wafer 5 to prevent separation of the wafer from the insert member and to maintain the insert member and wafer in proper position within the shell.

Referring to FIGS. 2 to 5, the special tool for assembling the connector has three coaxial sleeves 29, 31 and 33 movable axially relative to one another preferably by hydraulic pressure determined by the size of the connector.

Figure 4:
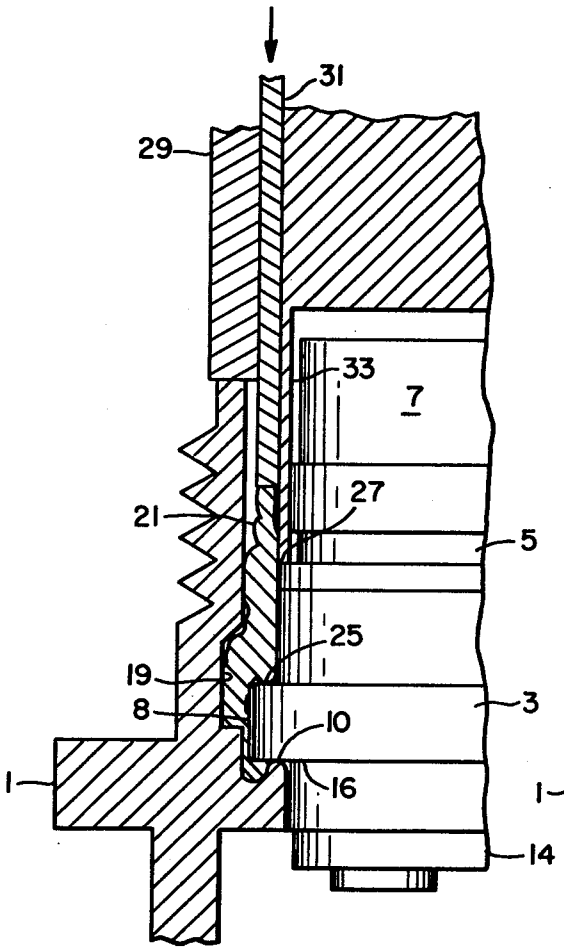
Figure 3:
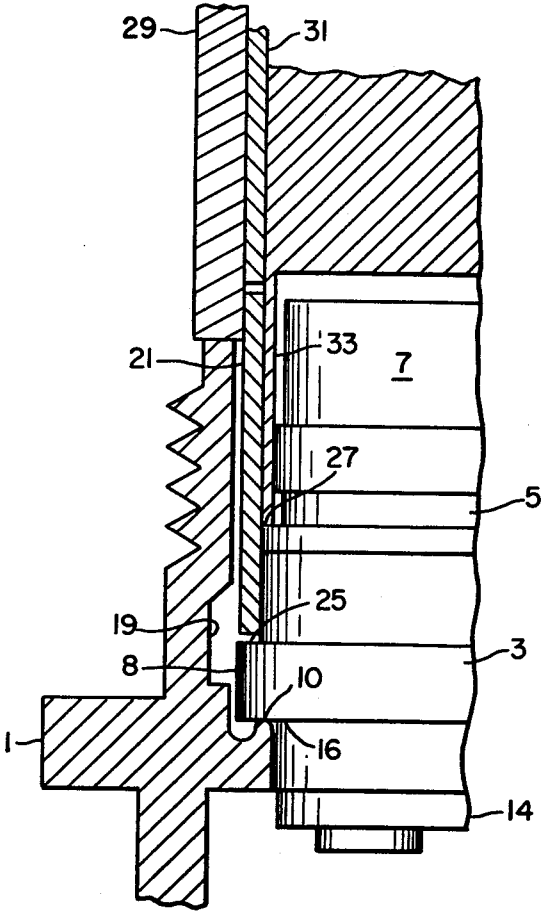

Retention wafer 5 and insert member 3 are bonded together by a solvent and grommet 7 and seal 14 are attached to retention wafer 5 and insert member 3 by adhesive with the apertures aligned. The members are inserted in innermost sleeve 33 with the end of the sleeve engaging shoulder 27 on wafer 5. With outer sleeve 29 retracted to the solid line position in FIG. 2, laminate 21 is wrapped around the stack exteriorly of inner sleeve 33 with one edge adjacent shoulder 25 on insert member 3. Outer sleeve 29 is then moved forwardly over the rear portion of the laminate to the broken line position in FIG. 2 and shell 1 is assembled over the stacked assembly, as outer sleeve 29 is retracted, until locating surface 10 on shell 1 engages shoulder 16 on insert member 3 as shown in FIG. 3. During this procudure, outer sleeve 29 prevents the laminate from becoming twisted or folded and facilitates assembly of the shell to the stacked assembly. Intermediate sleeve 31 moves forwardly between innermost sleeve 33 and the inner face of shell 1 and engages the laminate. As the intermediate sleeve 31 continues to move forwardly it functions as a ram and deforms the laminate over and around shoulder 25 on insert member 3 and in annular groove 19 in shell 1 as shown in FIG. 4 while inner sleeve 33 in forward position between deformed laminate 21 and grommet 7 engages shoulder 27 on wafer 5 and maintains the wafer in engagement with insert member 3 and maintains shoulder 16 on insert member 3 in engagement with locating surface 10 on shell 1.

Figure 5:
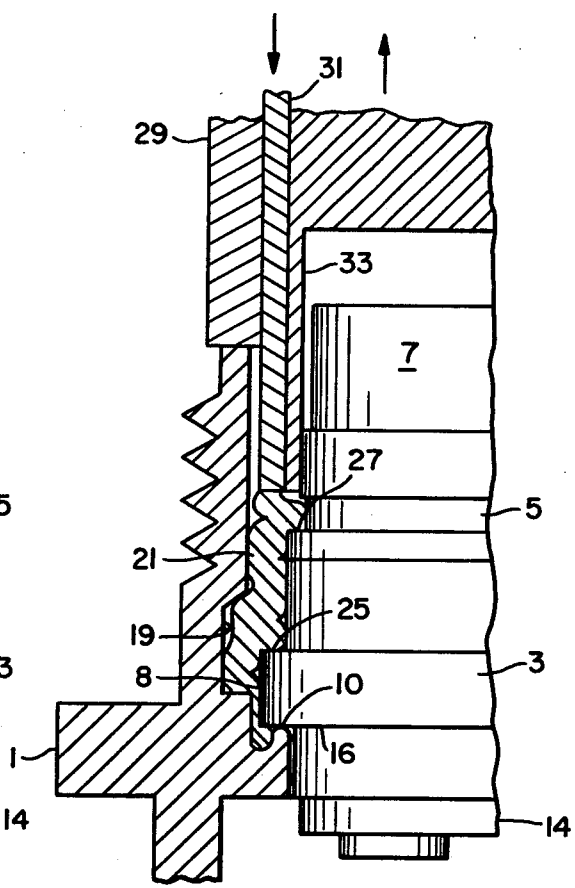

After the space between the shell and insert member and between the shell and wafer is substantially filled by the deformed laminate, inner sleeve 33 is retracted a short distance as shown in FIG. 5 and, as the laminate is further deformed by forward movement of intermediate sleeve 31, the laminate flows over and around shoulder 27 on wafer 5. The deformed laminate prevents both insert member 3 and wafer 5 from moving rearwardly in shell 1, and shoulder 16 on insert member 3 engaging locating surface 10 on the inner face of shell 1 prevents the insert member and wafer from moving forwardly in the shell. The deformed laminate maintains the insert member and wafer in assembly with one another and with the shell.

Terminals 11 are then inserted in the aligned apertures in the grommet, insert, wafer and seal until collars 17 on the terminals are bottomed on shoulders 15 in the apertures whereupon resilient elements 13 on wafer 5 engage collars 17 to prevent disassembly of the terminals during normal use of the connector.

Laminate 21 is made of a matrix, such as phosphorous bronze screen, fiber glass cloth or mat, or other suitable material. The matrix may be scalloped at one side on larger size connectors from 14 to 24 to reduce the deformation force, but on smaller size connectors, such as 8, 10 and 12, the scallops are not necessary because of the lower deformation force required. The matrix is coated with a thermal-setting material such as epoxy in the B stage, that is, before curing.

The appropriate matrix and epoxy viscosity, determined by the curing temperature, are selected for each particular condition. In one application 80 mesh phosphorous bronze screen impregnated by weight with 9% to 13% epoxy "B" stage was used and the epoxy was cured at 300° F for 10 hours.

The length, width and thickness of the laminate is predetermined so that after deformation the laminate substantially fills only the space between the shell and insert member and wafer including annular groove 19 without overflowing into the apertures in the insert assembly.

The thermo-setting material is cured by baking the assembly in an upright position with the mating face of the connector on top. The viscosity of the thermo-setting material is determined by the temperature during curing and the flow of thermo-setting material is controlled by the matrix to prevent the thermo-setting material from flowing into the apertures in the insert assembly.

The present arrangement avoids the disadvantages of connectors as used heretofore because the apertures and retention elements for receiving and retaining the terminals are free of thermo-setting material and the insert member and wafer are maintained in assembly with one another and with the shell by the deformed laminate.

While the invention shows a connector plug with male electrical terminals, it should be understood that the invention is intended for use on connector receptacles with female electrical terminals as well.

What is claimed is:

1. The method of assembling a connector having a shell and an insert member and wafer with appertures therein for receiving electrical terminals, comprising assembling the insert member and wafer member, wrapping a deformable laminate around the members, inserting the assembled members and laminate into the shell with the insert member abutting a shoulder on the inner face of the shell, inserting a first sleeve into the shell in engagement with the laminate, applying force to the first sleeve to deform the laminate in a space between the shell and members, maintaining a second sleeve within the first sleeve in engagement with a shoulder on the wafer member to maintain the members in assembled position with the insert member abutting the shoulder in the shell while applying force to the first sleeve to deform the laminate, and removing the first and second sleeves from the shell including the assembled members.

2. The method of assembling a connector as described in claim 1 in which the second sleeve is withdrawn from engagement with the shoulder on the wafer member while continuing to apply force to the first sleeve to deform the laminate over the shoulder on the wafer member.

3. The method of assembling a connector as described in claim 2 in which a grommet is assembled in the shell adjacent the wafer member with apertures in the grommet aligned with the apertures in the members, and inserting electrical terminals in the apertures in the grommet and members.

4. The method of assembling a connector as described in claim 3 including assembling a seal adjacent the insert member with apertures in the seal aligned with the apertures in the grommet and members.

5. The method of assembling a connector as described in claim 1 including assembling a grommet member to the insert member and wafer member, inserting the assembled members into the second sleeve with a portion of the assembly protruding therefrom, wrapping the deformable laminate around the second sleeve and protruding portion of the assembly, positioning a third sleeve exteriorly of the first sleeve over the laminate, and assembling the shell to the members around the laminate while retracting the third sleeve.

6. The method of assembling a connector as described in claim 5 in which a grommet is assembled in the shell adjacent the wafer member with apertures in the grommet aligned with the apertures in the members, and inserting electrical terminals in the apertures in the grommet and members.

7. A method of assembling a connector having a shell and an insert member and wafer with appertures therein for receiving electrical terminals, the steps of the method comprising:

assembling the insert member and wafer member;

wrapping a deformable laminate including a thermosetting material around the members;

engaging the assembled members and laminate with a tool having first and second sleeves;

inserting the tool and the engaged members and laminate into the shell;

applying a force to one of the sleeves to deform the laminate around the wafer and insert member;

removing the tool from within the shell and from engagement with the laminate and members;

heating the assembled members to cause the thermosetting material to liquify to fill the space between insert member and shell; and subsequently allowing the thermosetting material to cool and solidify, thereby fixing the insert member within the shell.

* * * * *